US008016897B2

(12) United States Patent
Lowery

(10) Patent No.: US 8,016,897 B2
(45) Date of Patent: Sep. 13, 2011

(54) AVIATION FUEL LEAD SCAVENGING ADDITIVE

(76) Inventor: Christopher Haydn Lowery, Tracy, CA (US)

( * ) Notice: Subject to any disclaimer, the term of this patent is extended or adjusted under 35 U.S.C. 154(b) by 246 days.

(21) Appl. No.: 12/264,420

(22) Filed: Nov. 4, 2008

(65) Prior Publication Data

US 2010/0107480 A1 May 6, 2010

(51) Int. Cl.
*C10L 1/18* (2006.01)
*C10L 1/22* (2006.01)
*C10L 1/26* (2006.01)

(52) U.S. Cl. ..... 44/382; 44/434; 44/443

(58) Field of Classification Search ..... 44/375, 44/382, 434, 443
See application file for complete search history.

(56) References Cited

U.S. PATENT DOCUMENTS 2,176,747 A * 10/1939 Schneider et al. ..... 44/439
3,622,519 A * 11/1971 Braxton, Jr. ..... 44/389
4,247,301 A 1/1981 Honnen
2005/0268540 A1 12/2005 Ahmadi et al.

* cited by examiner

*Primary Examiner* — Cephia D Toomer
(74) *Attorney, Agent, or Firm* — Berenato & White, LLC

(57) ABSTRACT

An aviation 100LL fuel additive formulation for lead scavenging which mitigates the detrimental effects of lead, cleans up the combustion chamber and also allows shipping and distribution by common carrier, such as UPS or FedEx. A fuel additive composition is described for aviation 100 octane Low Lead fuel, containing: (1) glycol ether 10 to 90% by volume; (2) tricresyl phosphate 5 to 10% by volume; and, (3) Polyetheramine 15 to 30% by volume. The described composition has a flash point above 141 degrees F. to enable safe shipping by common carrier. The described composition also contains polyetheramine to create a mixture which is shown to be effective in preventing plug fouling by lead and be effective in reducing combustion chamber deposits, thus providing a smooth running engine during ground operations.

16 Claims, 1 Drawing Sheet

Polyetheramine Type A

Polyetheramine Type B

R = H for Ethylene Oxide or CH3 for Propylene Oxide

Polyetheramine Type A

Polyetheramine Type B

R = H for Ethylene Oxide or CH3 for Propylene Oxide

AVIATION FUEL LEAD SCAVENGING ADDITIVE

BACKGROUND OF THE INVENTION

1. Field of the Invention

The invention relates generally to a leaded aviation fuel lead scavenging additive formulation that is relatively less toxic and more easily transported and handled than existing formulations.

2. Background

Lead scavenging additives for leaded aviation gasoline help to prevent lead deposits in the combustion chambers of piston engined aircraft. These deposits can prevent proper operation of the spark plugs and cause rough running of the engine, loss of power, etc. The use of tricresylphosphate (TCP) in additives for leaded aviation gasoline aircraft fuel (including one hundred octane low lead, 100LL) is known. The lead is added to fuel as tetraethyl lead by the gasoline maker, and the rate of addition is prescribed by the FAA (Federal Aviation Administration). The concentration can be from 2 milliliters/gallon fuel to 4 milliliters/gallon fuel, depending on the formulation. The use of polyether amines (PEA) in additives for automotive fuels is known. This is taught in U.S. Pat. No. 4,247,301 dated Jan. 27, 1981. PEA is not, however, described for aviation use. The use of polyisobutylene (PIB) and polyisobutylene amine (PIBA) in additives for automotive fuel is known, but also not for aviation use. Similarly, the use of glycol ether in additive mixtures for automotive fuel is known, but not for aviation use. This is taught in US Patent Application 2005/0268540 dated Dec. 8, 2005.

The most common piston engines for light aircraft are made by Lycoming, Rotax or Continental. Lycoming engines are made by a division of Textron and Continental engines are made by Teledyne. Rotax engines are made by a division of Bombardier. TCP has been used for three decades as an ingredient in an additive for aircraft leaded aviation gasoline (including 100LL, one hundred octane Low Lead), always added by the operator of the aircraft. It is not added by the distributor of the fuel. TCP additive helps prevent lead deposits on spark plugs. These deposits, which appear as gray lumps, are conductive to high voltage and bridge the electrodes on the spark plug, preventing a spark and rendering the spark plug inoperative. The deposits are mostly lead oxide. The TCP works by converting the lead to lead phosphate which is not conductive. Lead phosphate also has a higher melting point (800 to 1014 degrees C.) than lead oxide (370 to 886 degrees C.) and is therefore preferentially blown out with exhaust gasses. However, some of the lead phosphate created is not ejected from the engine and remains in the combustion chamber. This deposit then forms the base on which oily deposits can build up.

Plug fouling is mostly observed during ground operations prior to take-off. The accumulations occur mostly when fully rich mixtures are set for low power engine operation, a standard procedure during taxiing.

The acronym TCP was trademarked by Alcor Inc. and the product marketed as Alcor TCP. It contains TCP and toluene (flash point below 140 degrees F.) and is specifically banned from being carried in the cockpit of aircraft during flight because of the toluene content. It cannot be easily shipped by common carrier for the same reason.

Existing solutions for preventing or mitigating lead deposits in combustion chambers work well enough. But aircraft are traveling machines, and if it is not possible to carry this material in the cockpit then the pilot faces the problem of spark plug fouling and rough engine running at intermediate airport re-fuelling stops. This is potentially a dangerous situation with some engines. What is required is a formulation which allows the pilot to safely carry this material in the cockpit.

Furthermore, obtaining a lead scavenging mixture from a vendor is made much more difficult if the material is toxic or extremely flammable. The vendor may charge a high premium for shipping such a material and the carrier, such as UPS or FedEx may outright refuse to ship it.

Existing solutions were simply formulated too long ago, about thirty-five years, to meet the requirements of today's pilots.

SUMMARY OF THE INVENTION

The present invention advantageously fills the aforementioned deficiencies by providing an aviation fuel lead scavenging additive formulation that can be safely transported by common carrier. In addition, the invented formulation can be carried in the cockpit and be available to the pilot when refueling at intermediate airports on a route. As noted above, known formulations containing toluene cannot.

The invented formulation has a flash point of approximately 157 degrees F. and toxicity $LD_{50}$ of 700 mg/kg. $LD_{50}$ is the lethal oral dose in milligrams per kilogram of body weight which will kill 50% of a dosed population. The higher the flash point, the lower the volatility of the mixture. Existing formulations containing toluene have an $LD_{50}$ of 50 mg/kg and a flash point of 39 degrees F. It is therefore more than fourteen times more toxic than the invented formulation.

This invention describes a mixture of tricresyl phosphate (TCP), a polyetheramine and a carrier solvent consisting of 2-butoxyethanol, a glycol ether. The components are rigorously selected to avoid toxicity and high volatility. The selected TCP isomer for this invention contains less than 0.5% by weight of the extremely toxic ortho cresol isomer. The concentration is required to be below 3% to be shipped by air according to IATA (International Air Transport Association) regulations.

The polyetheramine may be omitted, for applications where it is not desired for this material to come in contact with lubricating oil. Thus in that example the formulation would consist only of TCP and 2-butoxyethanol. This would have all the benefits of shipping, transport and low toxicity of the invented formulation but would lack the property of combustion chamber cleaning.

Finally it is an object of the present invention to provide an aviation fuel lead scavenging additive formulation that does not suffer from any of the problems or deficiencies associated with prior solutions.

The present invention now will be described more fully hereinafter along with examples, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

This present invention is a formulation for preventing plug fouling when using leaded aviation gasoline, including 100LL, that can be carried in the cockpit of aircraft during flight and can also be shipped by common carrier, such as UPS and FedEx. The polyetheramine in this present formulation is also effective in preventing deposits in combustion chambers. Polyetheramine is being used in many auto gasoline formulations and is approved for such use by the EPA. The use of polyetheramines reduces fuel consumption, because of the reduction in combustion chamber deposits.

The present invention fuel additive for 100 LL aviation fuel is made up of the following elements:

Tricresyl phosphate (TCP)

Figure 1:
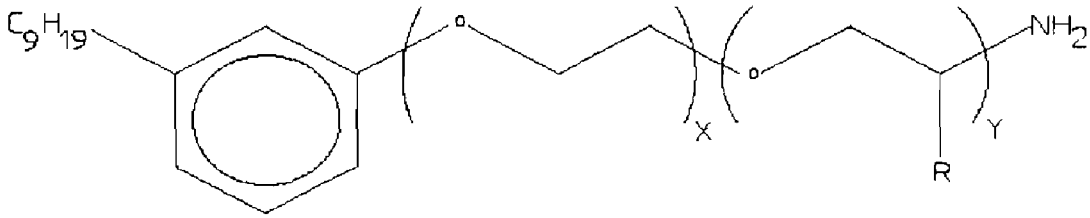
FIG. 1 type A and B are Polyetheramines (PEA) suitable for use in the claimed mixture.
Figure 1:
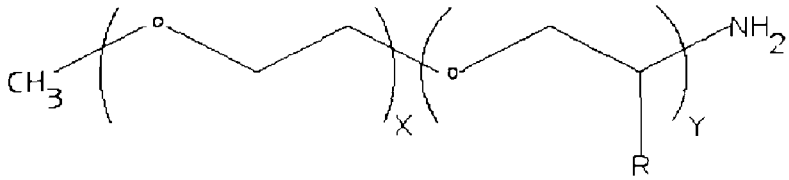

A Polyetheramine (PEA) as described in FIG. 1, and selected from the following Formula A and Formula B:

Formula A

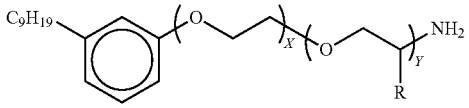

-continued

Formula B

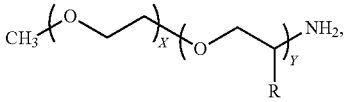

wherein R is selected from H and $CH_3$. The polyetheramine may be comprised of a linear alkyl chain in which there are propylene oxide moieties in a range of 2 to 30, terminating in a single amine group, i.e., R is CH3, y is in a range of 2 to 30, and x is 0. The polyetheramine may be comprised of a linear alkyl chain in which there are ethylene oxide moieties in a range of 2 to 30, terminating in a single amine group, i.e., R is H, x+y is in a range of 2 to 30. The polyetheramine may contain both ethylene oxide and propylene oxide moieties each in the range of 2 to 30, i.e., R is CH3, x is in a range of 2 to 30, and y is in a range of 2 to 30.

A Glycol ether, as described in Table 1

These elements are dissolved together to form a clear solution. The TCP and the PEA are added to the glycol ether. The . proportions of TCP, PEA and glycol ether are limited by their mutual solubility's of one in the other. The purity of the TCP should not be less than a Technical Grade, since materials other than the chemical description can prevent the formation of a clear solution. The polyetheramine is preferably, but not limited to, a primary amine. The primary amine is ethoxylated and propoxylated such that the molecular weight is in the range of 1,000 to 1,500, as shown in FIG. 1. The effectiveness of the PEA in this described mixture is limited by the solubility of the material in the other two components. The PEA used must also meet practical considerations, for example it must not precipitate from the mixture at extremes of use temperatures, nor must it react chemically with the other two components. Typical use temperatures would range from −20 degrees C. to 120 degrees C.

The purpose for using a solvent carrier such as glycol ether is to dilute the additive to practical volumes that can be easily added by the aircraft operator.

The following Table 1 is an illustrative list of glycol ethers which could be used, but the selection is not limited solely to those listed.

TABLE 1

| |
|---|
| Ethylene glycol monomethyl ether (2-methoxyethanol, $CH_3OCH_2CH_2OH$) |
| Ethylene glycol monoethyl ether (2-ethoxyethanol, $CH_3CH_2OCH_2CH_2OH$) |
| Ethylene glycol monopropyl ether (2-propoxyethanol, $CH_3CH_2CH_2OCH_2CH_2OH$) |
| Ethylene glycol monoisopropyl ether (2-isopropoxyethanol, $(CH_3)_2CHOCH_2CH_2OH$) |
| Ethylene glycol monobutyl ether (2-butoxyethanol, $CH_3CH_2CH_2CH_2OCH_2CH_2OH$), |
| Ethylene glycol monophenyl ether (2-phenoxyethanol, $C_6H_5OCH_2CH_2OH$) |
| Ethylene glycol monobenzyl ether (2-benzyloxyethanol, $C_6H_5CH_2OCH_2CH_2OH$) |
| Diethylene glycol monomethyl ether (2-(2-methoxyethoxy)ethanol, |
| methyl carbitol, ($CH_3OCH_2CH_2OCH_2CH_2OH$) |
| Diethylene glycol monoethyl ether (2-(2-ethoxyethoxy)ethanol, |
| carbitol cellosolve, ($CH_3CH_2OCH_2CH_2OCH_2CH_2OH$) |
| Diethylene glycol mono-n-butyl ether (2-butoxyethoxy)ethanol, $CH_3CH_2CH_2CH_2OCH_2CH_2OCH_2CH_2OH$) |
| Dialkyl ethers: |
| Ethylene glycol dimethyl ether (dimethoxyethane, $CH_3OCH_2CH_2OCH_3$), |
| Ethylene glycol diethyl ether (diethoxyethane, $CH_3CH_2OCH_2CH_2OCH_2CH_3$) |
| Ethylene glycol dibutyl ether (dibutoxyethane, $CH_3CH_2CH_2CH_2OCH_2CH_2OCH_2CH_2CH_2CH_3$) |

However, only a limited number of these are useful for the mixture described here. Some of these are not mutually soluble in TCP and PEA. Also, it is desirable for the flash point of the glycol to be sufficiently high for the mixture to be safe to transport. For a common carrier (such as UPS or FedEx) to transport such a mixture, the flash point must be above 68.1 degrees C. (141 degrees F.). Typical shipping quantities are 0.95 liters (1 US quart).

The preferred glycol ether is 2-butoxy ethanol, which has a flash point of 71 degrees C. (160 degrees F.). It is also miscible in all proportions with TCP and a suitable PEA and they do not precipitate or separate from the 2-butoxy ethanol in the temperature range −60 degrees C. to 120 degrees C.

It will be obvious to those skilled in the art that minor modifications to the glycol ether structure can create other glycol ethers not shown in Table 1. Those shown in Table 1 are intended to be illustrative of typical useful structures and the claims made in this disclosure are intended to fully include minor derivative structures also.

The fuel additive mixture described here is designed specifically for leaded aviation fuel, including one hundred octane low lead fuel (100LL). The materials taken separately or mixed together in any combination of two are not as effective in preventing lead deposits and combustion chamber deposits. The mixture described here is unique because it combines the advantages of TCP, PEA and a solvent.

In addition, it is safe to carry this mixture in a bottle in the cockpit, since the ingredients have a volatility of 0.6 mm Hg at 70 degrees C. For comparison, that of toluene is 3.8 mm Hg at 70 degrees C. Toluene was the solvent used for three decades for TCP used in fuel additives. Furthermore, the mixture described here can be safely shipped by common carrier, such as UPS and FedEx. Toluene mixtures cannot. In addition, formulations containing toluene are specifically banned by the manufacturer from being carried in the cockpit.

A high flash point, meaning that it must be raised to a high temperature before it will spontaneously ignite, is a very important beneficial property for both safe conveyance of the additive mixture during shipping and for the operator during flight.

The unique advantage disclosed here allows the operator to carry the additive during the flight and for it to be available during refueling stops at intermediate airports. The additive described consists of a mixture of TCP, PEA dissolved in glycol ether. The concentration of TCP is in the range of 2 to 20 percent by weight of the overall weight of the mixture. The concentration range of PEA is 5 to 70 percent by volume of the overall additive mixture. The preferred range of TCP is 5 to 10 percent by volume in the additive mixture. The preferred range for PEA is 15 to 30 percent by weight in the additive mixture. The remaining weight is made up with the glycol ether.

The mixed additive is added to leaded aviation at the preferred rate of 1 ounce per twenty gallons of fuel (0.0391% by volume), i.e. 39.1 ml per 100 liters of fuel. The addition rate can vary over the range of 0.5 ounce/20 gallons avgas to 2.0 ounce/20 gallons.

In addition, the PEA shall be a primary amine or diamine with a molecular weight range of 800 to 2,500. The preferred range is 1,000 to 1,500.

A special advantage of properly selected glycol ether is that it is miscible in some or all of the concentration ranges disclosed for PEA and TCP. It is also miscible in leaded aviation fuel. In addition, the PEA described here is soluble in some or all of the proportions in a properly selected glycol ether and leaded aviation fuel.

The disclosure here refers specifically to glycol ethers and does not include aliphatic or aromatic alcohols.

The preferred composition of the three component mixture described is:

1. 2-butoxy ethanol 80% by volume,
2. Polyether amine, molecular weight 1000-1,500, 15% by volume, as shown in FIG. 1.
3. Tricresyl Phosphate 5% by volume.

It is permitted to add a coloring dye to the mixture. When added at the rate of less than 0.5% it had no effect on the performance of the additive.

Example 1

In an engine test using the formulation described in Para 28 above, a turbocharged Rotax 914 aircraft engine was run at full power in a test stand without stopping for 350 hours. The described additive mixture was added at the rate of one ounce per twenty gallons of 100 LL (0.0391% measured by volume). At the completion of the test the engine was dismantled and examined. There were a few, soft deposits of carbon in the combustion chamber which were easily wiped away using isopropanol on a cloth. Typical carbon deposits are hard and must be chipped off. The inlet valve was clean and the turbocharger turbine wheel was clean.

An identical engine was run without the additive for a similar time for comparison. There were heavy carbon deposits in the combustion chamber, on inlet valves and on the turbine wheel. In addition, the average fuel consumption was 8% higher in the non-treated engine.

Example 2

An aircraft with a Lycoming 0320 engine was re-fuelled with 100LL aviation gasoline (commonly called Avgas). The aircraft was operated with normal ground operations technique, which means running the fuel mixture settings at "full-rich" during taxiing. During the pre-flight run up to check engine operation at 1700 rpm prior to take-off, the engine stumbled and would not run smoothly. The mixture setting was made more lean, i.e. with a higher air to fuel ratio and the throttle was opened so that the engine increased rpm to 2500 rpm. The engine stumble gradually subsided as the lead deposits which had accumulated on the spark plug were burned away. The run up was then repeated successfully. The fuel in the same aircraft was then treated with the preferred additive composition as described and taxied and run up exactly as before but no engine stumble was experienced.

The choice of 2-butoxy ethanol as the solvent is not obvious. There are a considerable number of glycols which could be considered, but this one, it was found, had the desired combination of solubility, high flash point and low toxicity.

The choice of grade of TCP is also not obvious. From a functional, chemical standpoint, any mixture of ortho, meta and para tricresyl phosphate will perform the lead scavenging function. But to satisfy the low toxicity transportation requirements of IATA (International Air Transport Association) the ortho isomer content must be below 3% by weight.

The choice of polyetheramine is also not obvious. Although many would satisfy the functional requirements of a combustion additive, many would be only sparingly soluble in the other components of the formulation, or they may precipitate at the low temperatures encountered in aircraft operations at higher altitudes, or during winter. This would make them dangerous, since they may block fuel lines. Some of the diamine ethers would be too alkaline and would corrode aluminum fuel lines in the presence of moisture.

It should be noted that polyetheramines always degrade slightly in storage above 60 degrees F., with less than 1% of the active material becoming a pale yellow or straw color over a one year time period. This change in appearance has no effect on the performance of the product in this application, since even the yellowed material is an active performance ingredient. The portion of the molecule which undergoes change is not the portion which is active in this application. Moreover, the yellowed portion always remains soluble in all proportions in the other ingredients and in aviation gasoline. The change in appearance is purely cosmetic.

In FIG. 1, the value of X and Y are selected so as to create a material which is liquid and is soluble in the other two ingredients, 2-butoxyethanol or selected glycol ethers chosen from Table 1 and tricresyl phosphate and meet other requirements as described in this document.

In FIG. 1, the preferred ratio of the ethylene oxide (EO) and propylene oxide (PO) moieties for Type A is approximately 1:5, that is the PO is five times more than the EO, with a total of X and Y being an average of 14, to achieve a molecular weight of approximately 1,000.

In FIG. 1, the preferred ratio of the EO to PO moieties for Type B is approximately 1:5, with the total of X and Y being an average of approximately 18 to achieve a molecular weight of 1,000 to 1,500.

In FIG. 1, in the Type B polyetheramine, the left side terminating methyl group may be replaced with another amine group, to produce a diamine.

In the Type A polyetheramine, the benzene ring may have in addition to the nonyl (nine carbon) group, an amine group substituent in the ortho, meta or para position, as available. This creates a diamine.

While the present invention has been described above in terms of specific embodiments, it is to be understood that the invention is not limited to these embodiments. Many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

I claim:

1. An aviation engine composition, comprising:

leaded aviation gasoline; and an aviation engine fuel additive mixture which comprises 2 to 20 percent by volume tricresyl phosphate;

5 to 70 percent by volume polyetheramine; and at least one glycol ether, wherein the polyetheramine comprises a member selected from the group consisting of:

Formula A

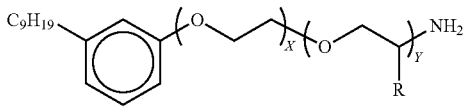

Formula B

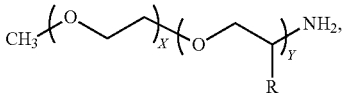

wherein R is selected from the group consisting of H and $CH_3$, wherein y is in a range of 2 to 30 and x is 0 or in a range of 2 to 30 when R is $CH_3$, and wherein x+y is in a range of 2 to 30 when R is H.

2. The aviation engine composition of claim 1, wherein R is $CH_3$ and y is in a range of 2 to 30.

3. The aviation engine composition of claim 1, wherein R is H and x+y is in a range of 2 to 30.

4. The aviation engine composition of claim 1, wherein the glycol ether has a flash point between 141° F. and 200° F.

5. The aviation engine composition of claim 1, wherein the glycol ether comprises 2-butoxyethanol.

6. The aviation engine composition of claim 1, wherein the glycol ether comprises a glycol ether or mixture of glycol ether selected from the group consisting of 2-methoxyethanol, 2-ethoxyethanol, 2-propoxyethanol, 2-isopropoxyethanol, 2-butoxyethanol, 2-phenoxyethanol, 2-benzyloxyethanol, 2-(2-methoxyethoxy)ethanol, methyl carbitol, 2-(2-ethoxyethoxy)ethanol, carbitol cellosolve, 2-butoxyethoxyethanol, dimethoxyethane, diethoxyethane, and dibutoxyethane.

7. The aviation engine composition of claim 1, wherein R is $CH_3$, x is in a range of 2 to 30, and y is in a range of 2 to 30.

8. The aviation engine composition of claim 1, wherein the polyetheramine comprises formula A.

9. The aviation engine composition of claim 8, wherein the polyetheramine comprises a phenyl group containing an amine substituent, R is $CH_3$, x is in a range of 2 to 30, and y is in a range of 2 to 30.

10. The aviation engine composition of claim 1, wherein the polyetheramine has a molecular weight in a range of 800 to 2,500.

11. The aviation engine composition of claim 1, wherein the aviation engine fuel additive mixture further 0.5 percent by weight or less dye.

12. The aviation engine composition of claim 1, wherein the aviation engine fuel additive mixture further comprises less than 0.5 percent by weight antioxidant.

13. The aviation engine composition of claim 1, wherein the aviation engine fuel additive mixture further comprises less than 0.15 percent by weight odorizing additive.

14. The aviation engine composition of claim 1, wherein the aviation engine fuel additive mixture further comprises up to 2 percent by volume of a solvent having a flash point above 141° F. for dissolving at least one member selected from the group consisting of an odorizing additive and an antioxidant additive.

15. The aviation engine composition of claim 14, wherein the solvent comprises isopropanol, dichlorobenzene, or a combination thereof.

16. The aviation engine composition of claim 1, wherein the tricresyl phosphate includes an ortho isomer content of below 3.0 percent by weight.

* * * * *